United States Patent [19]

Hilmersson et al.

[11] Patent Number: 4,603,490

[45] Date of Patent: Aug. 5, 1986

[54] ARRANGEMENT FOR THE TREATMENT OF A MOVING MATERIAL WEB

[75] Inventors: Anders E. Hilmersson, Helsingborg; Helge Andersson, Lund, both of Sweden

[73] Assignee: Tetra Pak International AB, Lund, Sweden

[21] Appl. No.: 615,819

[22] Filed: May 31, 1984

[30] Foreign Application Priority Data

Jun. 3, 1983 [SE] Sweden ..... 8303139

[51] Int. Cl.[4] ..... F26B 13/02

[52] U.S. Cl. ..... 34/155; 34/156; 34/160

[58] Field of Search ..... 34/155, 156, 160, 231

[56] References Cited

U.S. PATENT DOCUMENTS 3,372,630 3/1968 Schmidt ..... 34/156
3,947,249 3/1976 Egger .
4,321,757 3/1982 van der Blom .
4,411,075 10/1983 Blaudszun .
4,467,537 8/1984 Trotscher .

FOREIGN PATENT DOCUMENTS 3028208 2/1982 Fed. Rep. of Germany .

OTHER PUBLICATIONS

European Search Report of No. EP 84106126.0.

*Primary Examiner*—Larry I. Schwartz
*Attorney, Agent, or Firm*—Burns, Doane, Swecker & Mathis

[57] ABSTRACT

A chamber for treatment of a moving material web with an air flow for purposes of drying the web, the chamber including an inlet and an outlet for the flow of air, an inlet and outlet for the material web and a baffle plate disposed over the air outlet at an angle in relation to the path of travel of the web through the chamber.

9 Claims, 2 Drawing Figures

ARRANGEMENT FOR THE TREATMENT OF A MOVING MATERIAL WEB

FIELD OF INVENTION

The present invention relates generally to devices for sterilizing a moving material web and more particularly to an arrangement for the treatment of a moving material web comprising a chamber with input and output for the material web and inlet and outlet for a gas flow.

BACKGROUND OF THE INVENTION

In the packaging industry, for example, it is customary to treat a moving material web in different ways. During the manufacture of sterile packing containers from a material web the material web is usually sterilized before the conversion to individual packing containers. The sterilization is carried out with the help of a chemical sterilizing agent, e.g. hydrogen peroxide, which is supplied to the material web and is removed again after a certain period of treatment with the help of hot air. In the process the web passes into a chamber wherein one or more nozzles (so-called air knives) for hot air are directed towards the web. The chamber is also provided with an outlet for the treatment air and the sterilizing agent removed from the web. It is very important that during the treatment the web does not come into contact either with the nozzle or other parts in the chamber, since this results in damage to the web and possible loss of sterility. Since the amount of air as well as the air velocity have to be relatively high in order to remove the sterilizing agent effectively from the web, vigorous and not easily controllable air flows occur inside the chamber which render it very difficult to provide the web with a steady movement through the chamber, especially in the region where the air knife or the outlet from the chamber are situated. It is ideal if the web can be made to "float" in a calm and steady manner through the chamber without coming into contact at any point with neighbouring mechanical elements. Up to now it has been very difficult to achieve this, and it is generally desirable to provide a treatment chamber which makes this possible.

OBJECTS OF THE INVENTION

It is an object of the present invention to provide an arrangement for the treatment of a moving material web, this arrangement permitting treatment, and especially treatment with the help of a gas flow without the web during the passage through the chamber being acted upon so that an uneven, unsteady movement is imparted to it or so that it makes contact with any part of the arrangement.

It is a further object of the present invention to provide an arrangement of the abovementioned type which is not subject to the disadvantages of the earlier arrangements and which, moreover, is simple in its design and function.

SUMMARY OF THE INVENTION

These and other objects have been achieved in accordance with the invention in that an arrangement for the treatment of a moving material web comprising a chamber with input and output for the material web and inlet and outlet for a gas flow has been given the characteristic that the outlet is situated at the opposite side of the web in relation to the inlet and comprises an outlet opening and a baffle plate located between the outlet opening and the web which is arranged at an angle to the direction of movement of the web and has gas discharge gaps at the ends, these gaps having a ratio of mutual magnitude which is such that a greater part of the gas flow passes the baffle plate in the space between the baffle plate and the material web.

By placing the baffle plate between the material web and the outlet opening and at an angle to the direction of the movement of the web a partial vacuum is provided between the baffle plate and the material web, this partial vacuum balancing the partial vacuum caused on the other side of the material web by the air flow so that the material web can pass between the input and the output of the chamber in a calm and steady manner and without coming into contact either with the baffle plate or other parts of the chamber.

BRIEF DESCRIPTION OF THE DRAWING

A preferred embodiment of the arrangement in accordance with the invention will now be described in more detail with special reference to the attached schematic drawing which shows the details required for the understanding of the invention.

DETAILED DESCRIPTION OF THE PREFERRED EMBODIMENT

The arrangement in accordance with the invention can be used in the packaging industry for example for the removal of a surface coating of sterilizing agent from a packing material web. In this case the arrangement is placed at an appropriate position in the packing machine and preferably connected to a source of hot sterile air present in the machine. However, neither the source of sterile air nor other parts of the packing machine are described in this context, since they are appropriately of a design well-known in this branch of industry.

Figure 1:
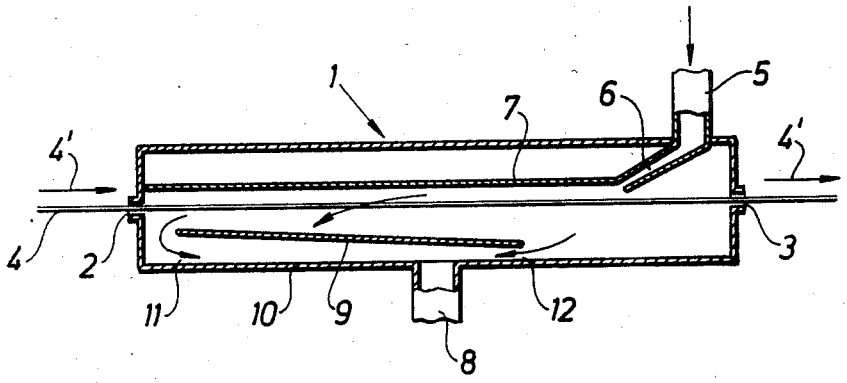
FIG. 1 is a schematic, sectional side view of an arrangment in accordance with the invention during operation.

The arrangement in accordance with the invention, as illustrated in FIG. 1, comprises an elongated chamber 1 which is manufactured from stainless steel and comprises an input 2 and an output 3 at its opposite ends. A packing material web 4 can pass substantially in a straight line via the input 2 and the output 3 through the chamber 1 in longitudinal direction of the latter and in so doing pass treatment elements present in the chamber. The direction of movement of the material web is indicated by means of arrows 4.

At the upper side of the chamber an inlet 5 is provided for gas, e.g. heated sterile air, which can be made to sweep the web via a nozzle 6 (air knife) directed at an angle towards the material web 4. A guide plate 7, extending parallel with the material web 4, constitutes an extension of one wall of the nozzle 6 and serves for steering the gas flow along the material web, which is illustrated by means of arrows. At the lower side of the chamber an outlet 8 is provided whose opening is screened off from the material web 4 with the help of a baffle plate 9 situated inside the chamber 1. The baffle plate 9 is thus situated between the opening of the outlet 8 and the material web 4 at such a distance above a wall 10 surrounding the outlet opening, that the gas, which flows between the lateral edges of the material web 4 and adjoining side walls (not visible in the figure) of the treatment chamber 1, can reach the outlet 8 via gas discharge gaps 11, 12 which are formed between the front and rear edge respectively of the baffle plate 9 and the wall 10. The wall 10 at the same time constitutes the bottom of the chamber 1. The placing and position of the baffle plate 9 in relation to the outlet 8 and the material web 4 is illustrated in greater detail in FIG. 2.

Figure 2:
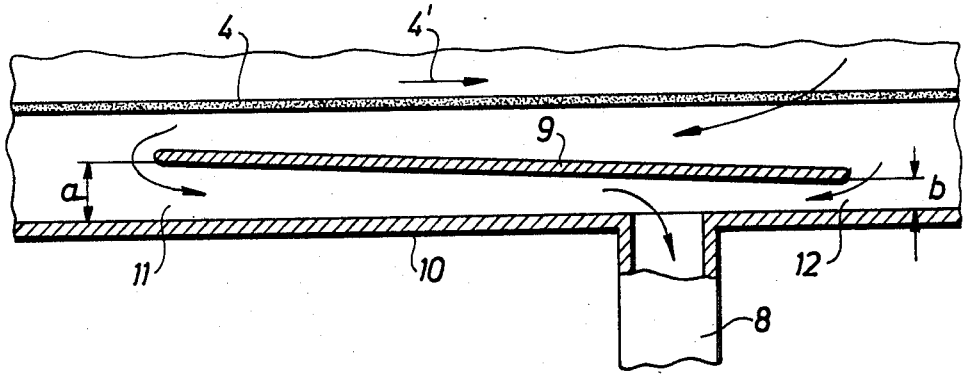
FIG. 2 shows on a larger scale and in section a part of the arrangement in accordance with FIG. 1.

In FIG. 2 is shown on a larger scale a limited region of the lower part of the chamber 1 in accordance with FIG. 1 and it is clearly evident how the baffle plate 9 is positioned in relation to the lower wall 10 of the chamber and the material web 4. The reference letters a and b indicate the width of the two gas passage gaps 11 and 12 respectively. Suitable values for a and b have proved to be 5 and 2.5 mm respectively which give the baffle plate 9 an inclination in relation to the material web 4 (and the wall 10) of 1°–3° depending on the length of the baffle plate. The length of the baffle plate has to be adapted to a certain extent to the amount of air passing through, and a suitable value under normal operating conditions has been found to be approx. 200 mm.

When the arrangement in accordance with the invention is mounted in position in a packing machine, the packing material web 4 during operation passes via the input and output 2 and 3 respectively through the chamber 1. The material web, which usually is constituted of a laminated material comprising outer layers of thermoplastics, has been provided, before reaching the chamber 1, with an outer coating of a bactericidal substance, e.g. hydrogen peroxide. The bactericidal agent is applied by means of known methods, e.g. by spraying or by causing the material web to pass through a bath of the bactericidal agent. After the bactericidal agent has completed its function it has to be removed from the material web which according to the invention is done in the chamber 1. For this purpose use is made in conventional manner of a so-called air knife, that is to say a narrow, vigorous jet of heated sterile air which is conducted at an acute angle towards the surface of the material web. The air flowing at a high velocity will then blow clean the surface and cause the relatively thin layer of sterilizing agent, e.g. peroxide to evaporate rapidly, whereupon the air mixed with evaporated sterilizing agent is conducted out of the chamber via the outlet 8 which is indicated by means of arrows in FIG. 1 as well as in FIG. 2.

The guide plate 7 positioned after the nozzle 6 ensures that the hot air flowing from the nozzle 6 passes over a certain distance in contact with the material web thus making sure that a complete heating and evaporation of the retaining sterilizing agent is achieved. The vigorous air stream along the web, however, causes a so-called Coanda effect which means that a partial vacuum is formed between the guide plate 7 and the material web 4 so that the material web 4 endeavours to lift off and approach the guide plate 7. At the same time, though, the material web is acted upon by the air passing through the outlet 8 which in previous designs resulted in a fluttering movement being imparted to the material which under unfavourable circumstances can result in damage to the material web owing to the latter coming into contact with, and resting against, parts of walls of the chamber 1 or adjoining elements. To prevent this and to ensure that the material web 4 "floats" in a suitable manner through the chamber 1 without touching any part of the same, use is made of the baffle plate 9 and its special placement in relation to the material web 4 and the outlet 8. With the help of the baffle plate 9 the air, which in the space between the longitudinal edges of the material web 4 and the (not visible) side walls of the chamber 1 passes from the upper side of the material web to its lower side is conducted so that it flows to a greater part between the baffle plate 9 and the material web 4 to be conducted via the gap 11 down underneath the baffle plate 9 and further out through the outlet 8. A smaller part of the air flows via the gap 12 to the outlet 8. With the help of the baffle plate 9 an increased velocity of flow of the air, which passes between the baffle plate 9 and the material web, is achieved thus generating a partial vacuum which owing to the Coanda effect counteracts the partial vacuum on the opposite side of the material web so that a comparatively calm "floating" movement can be imparted to the material web between the guide plate and the baffle plate 9. The arrangement becomes self-balancing inasmuch as the material web 4, if it approaches the baffle plate 9 too closely, reduces the free space for the air so that a greater part of the air is forced to pass the baffle plate 9 via the gap 12 thus diminishing the air flow between the baffle plate 9 and the material web 4 so that the partial pressure is diminished and the material web withdraws again from the baffle plate 9. In an analogous manner an increase in the distance between the material web 4 and the baffle plate 9 will result in an increased air flow along the baffle plate 9 and via the gap 11, which increases the partial vacuum and brings the material web again closer to the baffle plate 9.

The inclination of the baffle plate 9, the length and the width (a and b respectively in FIG. 2) of the gaps must be adapted to the particular air flow which is desirable with a view to the drying result. As suitable "standard values" it may be mentioned, however, that with an air flow of 100 $m^3$/hour and an air temperature of 130° C., the gap widths should be 5 and 2.5 mm respectively. This produces an inclination of 1°–3° for the baffle plate 9. The gap 11 (*a*) under all circumstances must be wider than the gap 12 (*b*) if the function of the arrangement is to be as desired, that is to say the distance between the baffle plate 9 and the material web 4 must increase viewed in the direction of movement of the material web 4. To ensure a correct flow it has also been found appropriate if the wall 10, which as a rule can constitute the lower wall in the chamber 1, is parallel with the direction of movement of the material web 4.

It is to be understood that the present invention may be embodied in other specific forms without departing from the spirit or essential characteristics of the present invention. The preferred embodiment is therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. An arrangement for the treatment of a moving material web comprising a chamber, a web inlet and a web outlet for defining a web path through the chamber, a gas inlet and a gas outlet for a gas flow, said gas outlet being situated at the opposite side of the web path in relation to the gas inlet and a baffle plate extending along said web path between said gas outlet and the web path, the baffle plate being arranged at an angle to said web path, said gas outlet being located in a first wall of said chamber, the ends of the baffle plate defining first and second gas discharge gaps between the baffle plate and said first wall, said first gap being greater than said second gap, said first gap being spaced further from said gas inlet than said second gap, whereby these gaps cause a greater part of the gas flow to pass through said first gap than through said second gap when said material web is moving along said web path.

2. The arrangement in accordance with claim 1 or 7, wherein said gas inlet is positioned closer to said web outlet than said web inlet and the distance between the baffle plate and the web path increases as viewed in the direction of movement of the material web along the web path.

3. The arrangement in accordance with claim 2, wherein an angle between the baffle plate and the material web path is in the range of approximately 1°–3°.

4. The arrangement in accordance with claim 3, wherein the first and second gas discharge gaps amount to 5 and 2.5 mm, respectively.

5. The arrangement in accordance with claim 4, wherein said first wall is parallel with the web path and forms a lower wall in the chamber.

6. An arrangement for the treatment of a moving material web comprising: a chmaber with a web inlet and a web outlet defining a web path through the chamber, a gas inlet, a guide plate adjacent said gas inlet for guiding a gas flow from said gas inlet over a first side of said web path and a gas outlet situated in a first chamber wall opposite of the web path from the gas inlet, said arrangement further comprising a baffle plate positioned between the gas outlet and the web path, the baffle plate being positioned at an angle to the direction of movement of web along the web path and having first and second ends, the first and second ends defining first and second discharge gaps with the first chamber wall, respectively, said first discharge gap being greater than said second discharge gap, said first discharge gap being spaced further from said gas inlet than said second discharge gap, so that a greater proportion of gas flowing through said chamber passes through said first discharge gap than through said second discharge gap when said material web is moving along said web path, whereby a floating movement may be imparted to the material web as the material web passes between said guide plate and said baffle plate.

7. The arrangement in accordance with claim 6, wherein the first chamber wall is parallel with respect to the web path.

8. The arrangement in accordance with claim 7, wherein said a guide plate extends substantially parallel to said web path.

9. The arrangement in accordance with claim 1 or 6, wherein the baffle plate is planar and inclined relative to the web path.

* * * * *